US007001196B1

(12) United States Patent
Huang

(10) Patent No.: US 7,001,196 B1
(45) Date of Patent: Feb. 21, 2006

(54) ROTATABLE PLUG WITH AN ARCING RESISTANT MECHANISM

(75) Inventor: Tzu-Hsuan Huang, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/072,444

(22) Filed: Mar. 7, 2005

(51) Int. Cl.
*H01R 13/62* (2006.01)

(52) U.S. Cl. ..... 439/320; 439/131

(58) Field of Classification Search ..... 439/320, 439/131, 172, 956
See application file for complete search history.

(56) References Cited

U.S. PATENT DOCUMENTS 6,126,460 A * 10/2000 Wu ..... 439/131
6,275,002 B1 * 8/2001 Chen ..... 320/111
6,641,412 B1 * 11/2003 Kitagawa et al. ..... 439/131

FOREIGN PATENT DOCUMENTS

JP 53-118787 * 10/1978

* cited by examiner

*Primary Examiner*—Michael C. Zarroli
(74) *Attorney, Agent, or Firm*—Rosenberg, Klein & Lee

(57) ABSTRACT

A rotatable plug with an arcing resistant mechanism is disclosed which includes an upper cover, a lower cover mating with the upper cover to form a holding space, a mount placed in the holding space, a rotatable rack placed on the mount, a pair of conductive terminals fixed on the lower cover and a pair of connecting slices. The rotatable rack includes a pivot and a pair of prongs, wherein the prongs are fixed on the both ends of the pivot respectively. Each connecting slice connects the corresponding prong of the rotatable rack with the corresponding conductive terminal. Therefore a circuit exists between the prongs and the conductive terminals, so that the rotatable plug with an arcing resistant mechanism can suppress the arcing that is produced between the prongs and the conductive terminals. Thus the rotatable plug with an arcing resistant mechanism is used safely and has a long lifetime.

6 Claims, 3 Drawing Sheets

ROTATABLE PLUG WITH AN ARCING RESISTANT MECHANISM

BACKGROUND OF THE INVENTION

1. Field of the Invention

The present invention generally relates to a rotatable plug, and more particularly, to a rotatable plug with an arcing resistant mechanism.

2. The Related Art

With popularization of consumer electronics, various kinds of plugs, especially rotatable plugs come out. Due to their small size for carrying conveniently and beautiful appearance, the rotatable plugs are favored even more. With reference to FIG. 5, a rotatable plug is disclosed below according to prior art.

The conventional rotatable plug 200 illustrated in FIG. 5 includes an upper cover 210, a lower cover 220, a mount 230 which is placed on the lower cover 220, a rotatable rack 240 placed on the mount 230 and a pair of conductive terminals 250 fixed on the lower cover 220 in juxtaposed relationship. A pair of slots 211 are formed longitudinally in parallel on the top surface of the upper cover 210. The upper cover 210 mates with the lower cover 220 to form a holding space for receiving the mount 230. The rotatable rack 240 is provided with a pair of prongs 242 fixed thereon. When the rotatable plug 200 is in use, the free end of each prong 242 passes through the corresponding slot 211 and is set on the vertical position exposed out of the upper cover 210 by rotating the rotatable rack 240 for electrically contacting with a receptacle. At this time, the other end of each prong 242 is electrically contacted with the corresponding conductive terminal 250. When the rotatable plug 200 is not in use, the free end of each prong 242 is held in the corresponding slot 211 completely by rotating the rotatable rack 240 reversely, and the other end of each prong 242 separates from the corresponding conductive terminal 250.

As described above, there is a problem that can not be ignored in use of the conventional rotatable plug 200. That is, as the conventional rotatable plug 200 is inserted into the corresponding receptacle, an arcing has to be produced between the prongs and the corresponding conductive terminals. The reason of the arcing phenomenon is that a gap exists in course of rotating the rotatable plug 200, for each prong 242 of the rotatable plug 200 is contacted with the corresponding conductive terminal by means of touching. As well known to all, the arcing terrifies users, and even more threatens the safety of the user. Furthermore, the arcing releases a lot of heat so as to make the conductive terminal 250 in high temperature. As a result, the conductive terminal 250 will be oxidized easily, and the lifetime of the rotatable plug 200 is reduced. Thus, there is a demand for providing a rotatable plug that can overcome the above shortcomings.

SUMMARY OF THE INVENTION

An object of the present invention is to provide a rotatable plug with an arcing resistant mechanism which can suppress arcing, and the rotatable plug can be used safely and has a long lifetime.

To achieve the above object, the present invention provides a rotatable plug with an arcing resistant mechanism including an upper cover, a lower cover which mates with the upper cover to form a holding space, a mount placed on the lower cover and held in the holding space, a rotatable rack supported by the mount, a pair of conductive terminals disposed on the lower cover, and a pair of connecting slices each of which connects the rotatable rack with the corresponding conductive terminal. A pair of slots are defined in parallel on the top surface of the upper cover. Each conductive terminal has an engagement portion and a contact portion extending from the engagement portion, wherein the engagement portion is secured on the lower cover for mating with a terminal of a receptacle. The rotatable rack includes a pivot and a pair of prongs, which rotates around the axis of the pivot between vertical position and parallel position with respect to the slots so as to make the prongs extending out of or be held in the slots. When the prongs are set on the position of vertical to the slots by rotating the rotatable rack, the prongs extend out the slots upwardly for being inserted into the receptacle. When the prongs are set on the position of parallel to the slots by rotating the rotatable rack, the prongs are held in the slots. Each connecting slice has a transferring portion, a conductive portion, and a connecting portion. The conductive portion and the connecting portion are bent and extended from both ends of the transferring portion respectively. The conductive portion electrically connects with the corresponding prong, and the connecting portion electrically contacts with the contact portion of the corresponding conductive terminal.

As can be seen from the above description, a circuit exists between the prongs of the rotatable rack and the conductive terminals, so that the rotatable plug with an arcing resistant mechanism can suppress the arcing that is produced between the prongs of the rotatable rack and the conductive terminals, and thus the rotatable plug with an arcing resistant mechanism is used safely and has a long lifetime.

BRIEF DESCRIPTION OF THE DRAWINGS

The present invention will be apparent to those skilled in the art by reading the following description of embodiment thereof, with reference to the attached drawings, in which.

DETAILED DESCRIPTION OF THE PREFERRED EMBODIMENT

Figure 1:
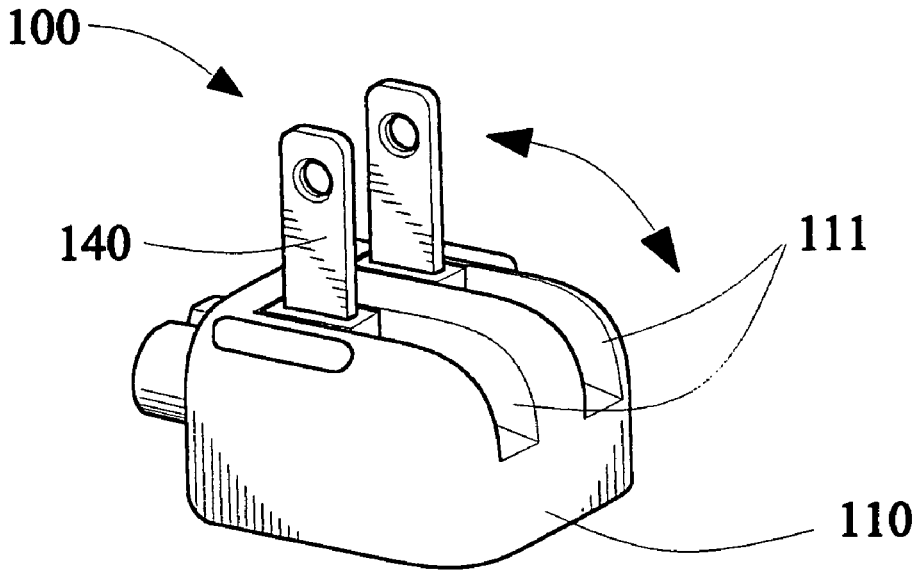
FIG. 1 is a perspective view of a rotatable plug with an arcing resistant mechanism according to the present invention.
Figure 2:
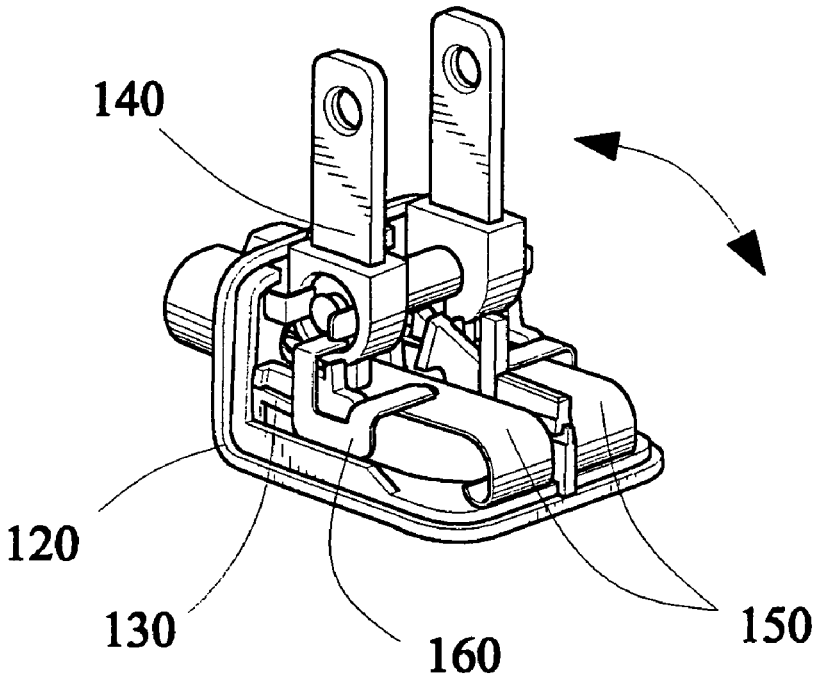
FIG. 2 is a perspective view of the rotatable plug prior to assembling with the upper cover as shown in FIG. 1.

With reference to FIG. 1 and FIG. 2, a rotatable plug with an arcing resistant mechanism 100 is disclosed which includes an upper cover 110, a lower cover 120 mating with the upper cover 110 to form a holding space, a mount 130 placed on the lower cover 120 and held in the holding space, a rotatable rack 140 supported by the mount 130, a pair of conductive terminals 150 disposed on the lower cover 120, and a pair of connecting slices 160 which connect the rotatable rack 140 with the conductive terminals 150 respectively. There are two slots 111 defined on the top surface of the upper cover 110, and the two slots 111 are set in parallel along the transversal direction for the rotatable rack 140 to pass through and to be held therein.

Figure 3:
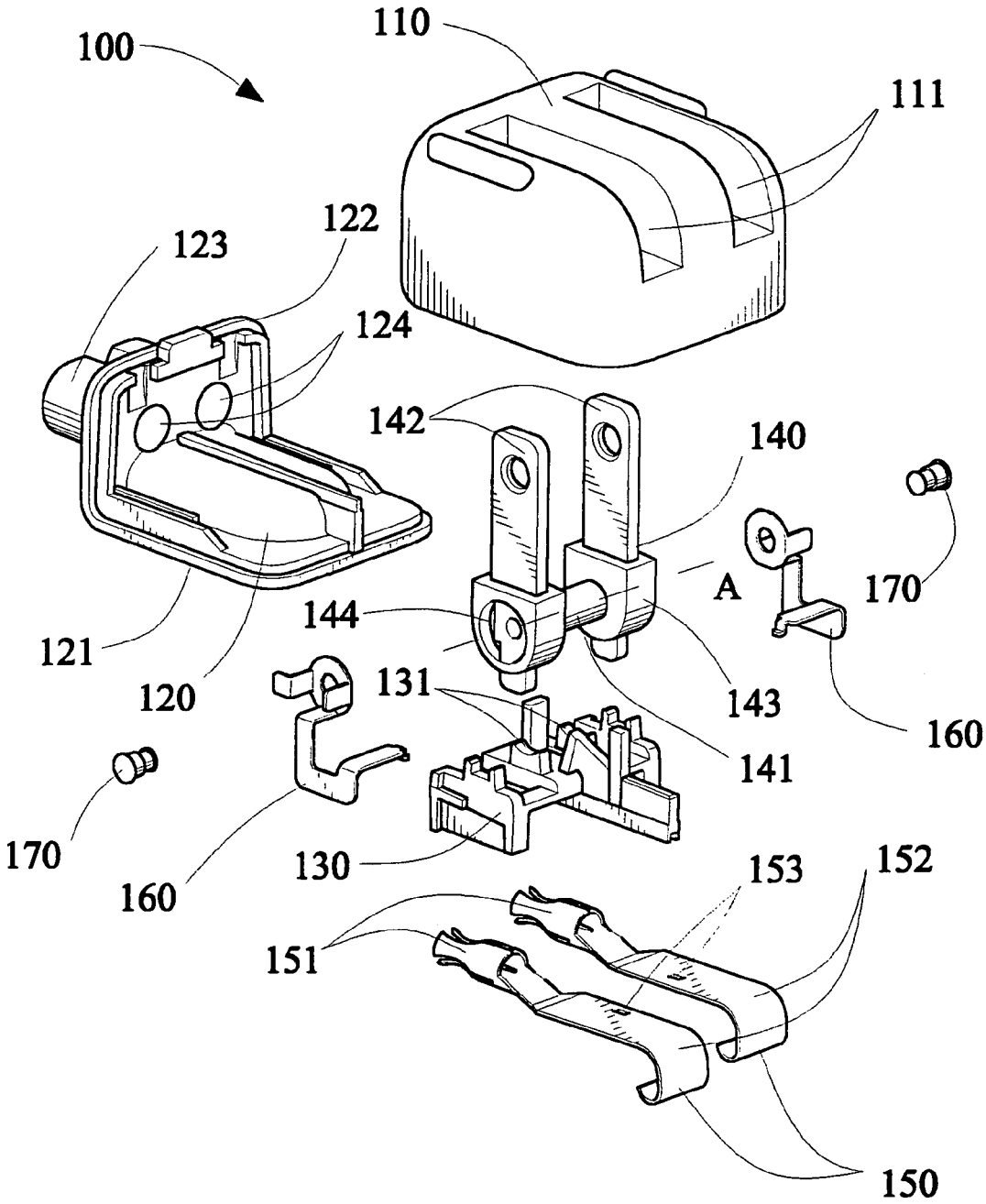
FIG. 3 is an exploded perspective view of the rotatable plug as shown in FIG. 1.

Along with reference to the FIG. 3, the lower cover 120 includes a base 121 and a vertical wall 122. The vertical wall 122 extends from the front side of the base 121. A protrusion 123 is extended from the outer surface of the vertical wall 122, and two openings 124 are formed in the protrusion 123. The conductive terminal 150 has an engagement portion 151 and a contact portion 152. The engagement portion 151 is shaped into a tube for engaging with a probe of a corresponding receptacle (not shown in FIGS) and fastened in the opening 124. The contact portion 152 extends from the engagement portion 151 and electrically contacts with the rotatable rack 140. Furthermore, each contact portion 152 of the conductive terminals 150 is provided with an aperture 153.

The mount 130 is placed on the base 121 of the lower cover 120, which has two juxtaposing posts 131. Each of the posts 131 has a concave on the top surface thereof for supporting the rotatable rack 140. The rotatable rack 140 includes a pivot 141 and a pair of prongs 142. A seat 143 is provided at each end of the pivot 141 for securing the corresponding prong 142, and there is a hole 144 in the outer lateral side of the seat 143. The rotatable rack 140 can rotate around the axis A of the pivot 141 to make the prongs 142 vertical to or parallel to the slots 111. When the rotatable plug with an arcing resistant mechanism 100 is in use, the prongs 142 are rotated to the position of vertical to the slots 111. At this position, one end of the prongs 142 contacts with the contact portion 152, the other end extends out the slot 111 and is inserted into a corresponding receptacle (not shown in FIGS). When the rotatable plug with an arcing resistant mechanism 100 is not in use, the prongs 142 are rotated to the position of parallel to the slots 111 and held therein, and at this position, the prongs 142 are apart from the contact portion 152 of the corresponding conductive terminals 150.

According to the above description, each prong 142 of the rotatable rack 140 contacts with the corresponding conductive terminal 150 by means of touching, therefore there is a space between the prong 142 and the corresponding conductive terminal 150. In order to avoid the producing of arcing in the space at the moment of the prongs 142 inserted into the corresponding receptacle, each connecting slice 160 of the rotatable plug with an arcing resistant mechanism 100 connects the rotatable rack 140 with the corresponding conductive terminal 150 to form a circuit therebetween. The detail of the connecting slice 160 is described below.

Figure 4:
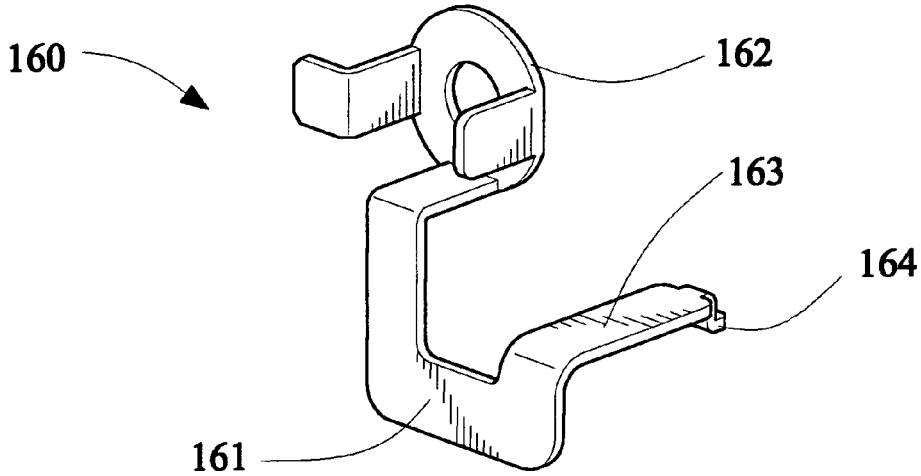
FIG. 4 is a perspective view of a connecting slice of the rotatable plug as shown in FIG. 2.
Figure 5:
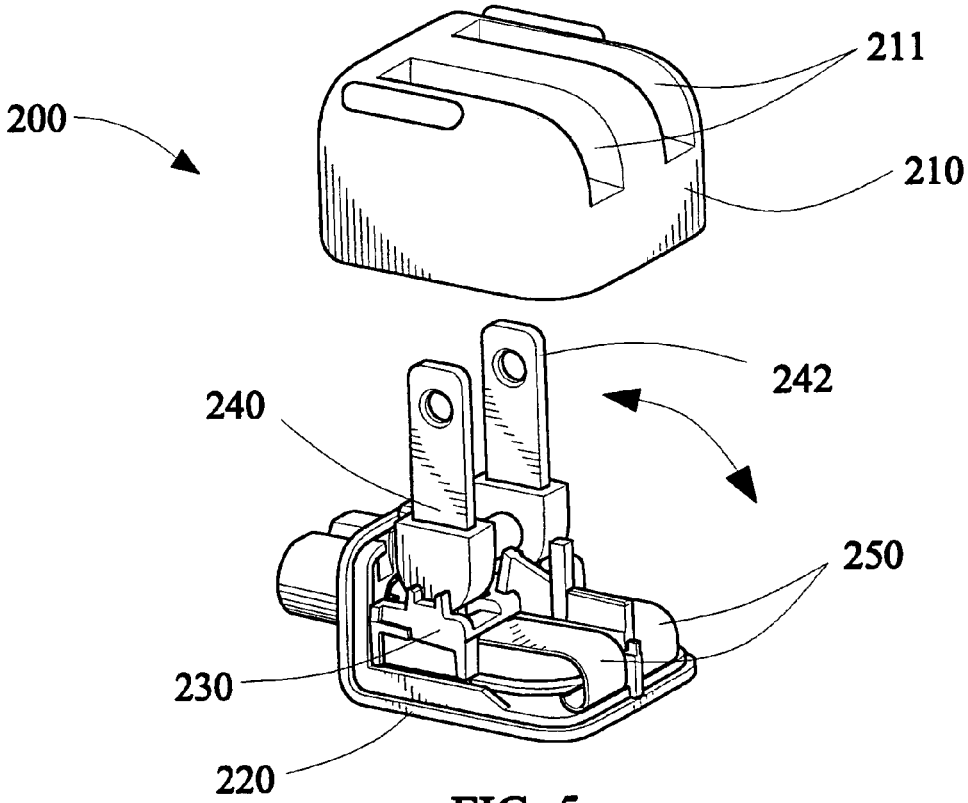
FIG. 5 ( PRIOR ART )
FIG. 5 is a perspective view of a rotatable plug according to a prior art.

As seen in FIG. 4, the connecting slice 160 has a transferring portion 161, a conductive portion 162, and a connecting portion 163, wherein the conductive portion 162 and the connecting portion 163 are bent and extended from both ends of the transferring portion 161 respectively. The conductive portion 162 is inserted into the hole 144 of the seat 143 and electrically connects with the corresponding prong 142, in this embodiment, the conductive portion 162 pivots with the seat 143 by a rivet 170, of course, other means is also adapted such as by a bolt and the like. The connecting portion 163 electrically contacts with the contact portion 152 of the conductive terminal 150. In order to make the connecting portion 163 contacting with the contact portion 152 tightly, a retention portion 164 extends from one end of the connecting portion 163, and the retention portion 164 is inserted into the aperture 153 of the conductive terminal 150 and bears against the bottom surface of the conductive terminal 150. Therefore there is predetermined resilience in the connecting portion 163 to make the connecting portion 163 contacting with the contact portion 152 tightly. As a result, a circuit is formed between the rotatable rack 140 and the conductive terminals 150 by the connecting slice 160.

When the rotatable plug with an arcing resistant mechanism 100 is inserted into the corresponding receptacle, electrical current will transfer between the conductive terminals 150 and the prongs 142 through the connecting slice 160, therefore the arcing is suppressed in the rotatable plug 100, consequently, the rotatable plug 100 in the present invention has advantages of safety and long lifetime for use.

Although the invention has been described above by reference to a certain embodiment of the invention, the invention is not limited to the embodiment described above. Modifications and variations of the embodiments described above will occur to those skilled in the art, in light of the above teachings.

What is claimed is:

1. A rotatable plug with an arcing resistant mechanism comprising:
   - an upper cover which defines a pair of slots in parallel on the top surface thereof;
   - a lower cover which mates with the upper cover to form a holding space;
   - a mount placed on the lower cover and held in the holding space;
   - a pair of conductive terminals disposed on the lower cover, each of which has an engagement portion and a contact portion extending from the engagement portion, wherein the engagement portion is fastened on the lower cover;
   - a rotatable rack supported by the mount and including a pivot and a pair of prongs, which rotates around the axis of the pivot between vertical position and parallel position with respect to the slots to make the prongs extending out of the slots or be held in the slots; and
   - a pair of connecting slices, each of which has a transferring portion, a conductive portion, and a connecting portion, wherein the conductive portion and the connecting portion are bent and extended from both ends of the transferring portion respectively, the conductive portion electrically connects with the corresponding prong, and the connecting portion electrically contacts with the contact portion of the corresponding conductive terminal.

2. The rotatable plug with an arcing resistant mechanism as claimed in claim 1, wherein an aperture is defined on the contact portion of each conductive terminal, correspondingly, and a retention portion extends from one end of the connecting portion of each connecting slice for being inserted into the corresponding aperture and bearing against bottom surface of the corresponding conductive terminal.

3. The rotatable plug with an arcing resistant mechanism as claimed in claim 1, wherein at each end of the pivot a seat is provided respectively for the conductive portion of connecting slices fastened therein.

4. The rotatable plug with an arcing resistant mechanism as claimed in claim 3, wherein a hole is formed in the outer side of each seat for the correspondingly conductive portion positioned therein and connecting with the corresponding prong.

5. The rotatable plug with an arcing resistant mechanism as claimed in claim 4, wherein the conductive portion is positioned in the seat by a rivet.

6. The rotatable plug with an arcing resistant mechanism as claimed in claim 4, wherein the conductive portion is positioned in the seat by a bolt.

* * * * *